United States Patent [19]

Seamon

[11] 3,952,618

[45] Apr. 27, 1976

[54] EXTRACTOR FOR PLASTIC RISERS

[75] Inventor: Paul Seamon, Garden Grove, Calif.

[73] Assignee: Honey Bee Tool Company, Whittier, Calif.

[22] Filed: May 23, 1975

[21] Appl. No.: 580,429

[52] U.S. Cl. ..... 81/71; 81/53.2
[51] Int. Cl.[2] ..... B25B 13/48
[58] Field of Search ..... 81/71, 53.2

[56] References Cited

UNITED STATES PATENTS

| | | | |
|---|---|---|---|
| 1,554,287 | 9/1925 | McGuckin | 81/71 |
| 1,604,032 | 10/1926 | Ferrell | 81/53.2 |
| 2,066,132 | 12/1936 | Zihler | 81/71 |
| 2,244,824 | 6/1941 | Caminez | 81/71 |
| 3,216,292 | 11/1965 | Flegal | 81/53.2 |

*Primary Examiner*—James L. Jones, Jr.
*Attorney, Agent, or Firm*—Edgar W. Averill, Jr.

[57] ABSTRACT

A device for extracting plastic risers from fittings such as polyvinyl-chloride water sprinkler pipes. The device has a shallow frusto-pyramidal shank having slightly concaval sides. The opposed edges of the shank lie at an angle of between 1.5° and 5° with respect to the longitudinal axis of the shank. The shank has a left-handed twist between 4° and 36° per inch of shank length. The shank is affixed to an extension rod which, in turn, has a handle to permit turning the device about its longitudinal axis.

6 Claims, 4 Drawing Figures

31
30
10
11
12
13
14
15
20
21
22
23
24
32
33
34
a
b
c
d
e
e/2
f
4

EXTRACTOR FOR PLASTIC RISERS

BACKGROUND OF THE INVENTION

The field of the invention is plumbing devices and the device is more particularly useful for extraction of plastic risers of the type commonly used in low pressure water piping such as lawn sprinkler piping.

A widely used type of riser for interconnecting a lawn or garden sprinkler head with an underground tee comprises a relatively soft hollow plastic member having a plurality of threaded sections with a relatively thin walled length between each section. Such risers are readily adapted for use without the necessity of special tools in that the thin walled section can be readily cut with a pocket knife to the desired length. Such risers typically have six sections, each being about one inch in length. For use in lawn sprinklers, the desired length can be determined and the proper number of sections cut away from the riser.

Unfortunately, in return for the relative ease of cutting lengths from risers of the type described above, an undesired side effect occurs—that is, such risers may be relatively easily broken because of the existence of the deliberately weakened section between each of the sections of the riser. Breakage often occurs when the sprinkler head is struck with a lawn mower or other object and the result is frequently a broken riser beneath the ground level.

In the past, there has been no easy method of removing such broken risers if the break could not be reached from the ground level. Typically, such attempts result in dirt and other objects falling into the sprinkler pipe which later results in clogged sprinkler heads. Other attempts often cause damage to the plastic threads on the tee in those instances where plastic tees are used.

Attempts to use reverse thread extractors of the type commonly used with metal plumbing fixtures lead to an undesirable expansion of the riser which results in damage to the threads of the tee.

SUMMARY OF THE INVENTION

The present invention is for a device for extracting plastic risers of the type commonly used with lawn sprinklers. The device has a shallow frustro-pyramidal shank having slightly concaval side surfaces. The opposed edges or corners of the frustro-pyramidal shank have an angle between about 1.5° and 5° with respect to the longitudinal axis of the shank, and the shank has a left-handed twist of between about 4° and 36° per inch of shank length. An extension rod is affixed to the shank and handle means are affixed to the end of the extension rod. A particularly useful tool results from the use of an angle of the edge of the device of about 3.5° with respect to the axis of the shank and where the twist in the shank is about 12° per inch of shank length.

DESCRIPTION OF THE PREFERRED EMBODIMENTS

Figures 1, 2, 3, 4:
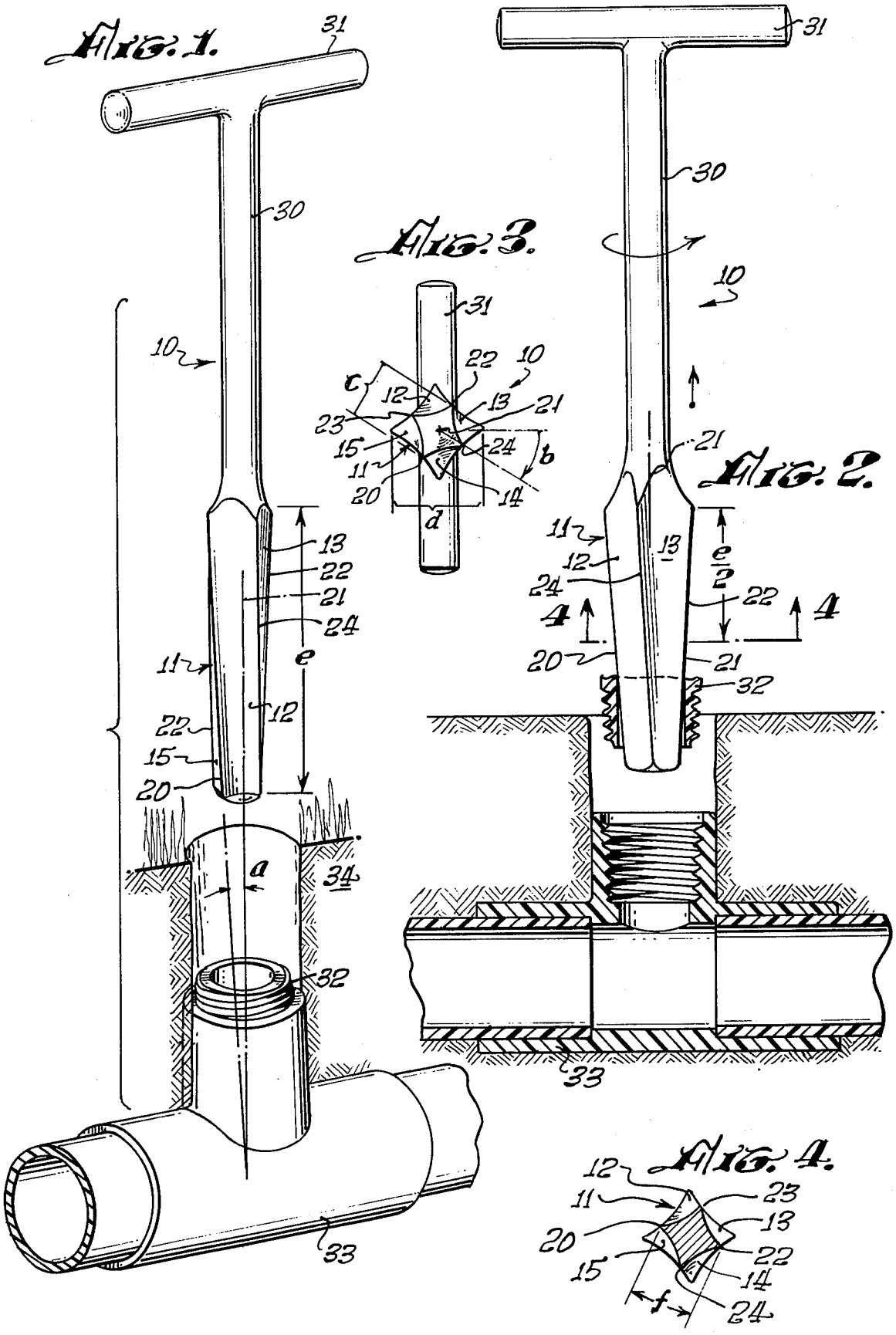
FIG. 1 is a perspective view of the device of the present invention together with a subterranean tee and riser assembly.
FIG. 2 is a side elevation partly in cross-section of the device and assembly of FIG. 1.
FIG. 3 is an end view of the device of FIG. 1.
FIG. 4 is a cross-sectional view taken along line 4—4 of FIG. 2.

The device of the present invention is shown in FIG. 1 and indicated generally by reference character 10. The extractor has a frustro-pyramidal shank having four slightly concave sides shown most clearly in FIG. 3 and indicated by reference characters 12 through 15. As shown in FIG. 1, the angle between edge 20 and the center axis 21 of the extractor is indicated by reference character "*a*".

The shank portion is given a slight twist in a "left-handed" direction. By the term left-handed, it is intended to indicate that the twist would tend to tighten the shank into a cylinder when the extractor is turned in a counter-clockwise direction. The degree of twist is shown in FIG. 3 by reference character "*b*", which shows the degree of twist along edge 24 for the length of the shank. The distance between opposing corners at the lower or terminal edge of the shank is indicated by reference character "*c*" whereas the difference between opposing characters at the upper end of the shank is indicated by reference character "*d*". The device is shown in cross-sectional view along line 4—4 of the shank, the length of the shank being indicated by reference character "*e*", and one-half the length by reference character *e*/2". The cross-sectional view in FIG. 4 indicates the distance between opposing edges at the point of cross-section by reference character "*f*". An extension rod 30 connects the shank to handle 31.

In operation, the shank is inserted into a broken riser 32 which has been screwed into tee 33. The sod or earth is indicated by reference character 34. The ground level is typically between three and six inches above the top of tee 33, thereby making removal of a broken tee a difficult matter.

In operation, the shank is inserted into riser 33 and the extractor is turned in a counter-clockwise direction. Because of the slight twist in shank 11, the extractor bites into the soft broken plastic riser and yet does not expand the same to a degree sufficient to damage tee 33. The riser can thus be readily removed in a manner shown in FIG. 2.

The degree of taper of the shank forms an important part of the present invention. If the shank is excessively tapered it will not hold a soft plastic riser but instead will simply cut the upper inner surface of the riser. Plastic risers of the type commonly used in water pipe are fabricated from a soft plastic such as polyethylene which is by nature a relatively slippery plastic. It has been found that an angle of between 1.5° and 5° with respect to the central axis of the shank is satisfactory with an angle of about 3.5° being ideal.

Similarly, the amount of twist imparted to the shank is another important feature of the present invention. If the amount of twist is too great, the extractor will tend to expand the riser leading to potential damage to the tee. It has been found that a twist of between 4° and 36° per inch of shank length provides a satisfactory reverse twist while still causing a proper balance between tightening onto the riser without unduly expanding it. A twist of about 12° per inch of shank length is considered ideal for polyethylene risers.

A particularly effective extractor for use on ½ inch polyethylene risers was fabricated from sand-cast aluminum alloy. The extractor has a shank length of 2½ inches, an extension rod length of 3½ inches, and an edge angle of 3.5° with respect to the central axis of the shank. The opposed edges at the bottom of the extractor are ½ inch apart and the opposed edges at the upper end of the shank portion are ¾ inch apart. The sand-casting causes a small amount of roughness which is believed to help the extractor grip the riser. While the above device was described as being fabricated from alluminum alloy, other materials of construction may be used as long as they are significantly harder than polyethylene of the type commonly used in the fabrication of risers. Rigid polyvinyl-chloride, phenolic or other relatively hard plastics may also be used. In the event ¾ inch risers are used in place of the more commonly used ½ inch risers, the dimensions of the extractor should be scaled up proportionately while maintaining however the above-described edge angle and degree of twist.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A device for extracting plastic risers from threaded fittings such as a tee located in a sprinkler pipe, said device comprising:

a shallow, frustro-pyramidal shank having slightly concaval sides, each corner of said frustro-pyramidal shank being at an angle of between 1.5° and 5° with respect to the longitudinal axis of said shank, and said shank having a left-handed twist between 4° and 36° per inch of shank length;

an extension rod affixed to said shank; and handle means affixed to said extension rod.

2. The device of claim 1 wherein each of said corners is at an angle of about 3.5° with respect to said center axis.

3. The device of claim 1 wherein said twist is about 12° per inch of shank length.

4. The device of claim 1 wherein said device is adapted for use on a ½ inch soft plastic riser and each corner of said shank has an angle of about 3.5° with respect to the center axis thereof, the distance between the corners of said shank at its bottom terminus is ½ inch, said shank extends a distance of about 2½ inches and the distance between opposed corners of said shank at a point 2½ inches from said terminus is about ¾ inch.

5. The device of claim 4 wherein said extension rod is about 3½ inches long.

6. The device of claim 1 wherein said device is fabricated from sand-cast metal.

* * * * *